US005456358A

United States Patent [19]

Schmidt

[11] Patent Number: 5,456,358

[45] Date of Patent: Oct. 10, 1995

[54] TOOL BOX

[75] Inventor: LaVern Schmidt, Montezuma, Kans.

[73] Assignee: Montezuma Welding & Mfg., Inc., Montezuma, Kans.

[21] Appl. No.: 263,559

[22] Filed: Jun. 22, 1994

[51] Int. Cl.[6] ..... B65D 85/00; B65D 85/26

[52] U.S. Cl. ..... 206/373; 206/372; 206/374; 206/375; 206/378

[58] Field of Search ..... 206/373, 374, 206/375, 378, 372, 324; 211/70.6; 220/318

[56] References Cited

U.S. PATENT DOCUMENTS

| | | | |
|---|---|---|---|
| 1,763,756 | 6/1930 | Casapollo | 220/324 |
| 3,003,618 | 10/1961 | Lebedzinski | 206/373 |
| 4,266,835 | 5/1981 | Schmidt . | |
| 4,303,158 | 12/1981 | Perkins | 206/373 |
| 5,169,018 | 12/1992 | Fiore | 220/318 |
| 5,193,706 | 3/1993 | Hanna et al. | 220/324 |
| 5,242,050 | 10/1993 | Billings | 206/372 |

OTHER PUBLICATIONS

Brochure of Montezuma Welding & Mfg., Inc., entitled "Compact Position Lock Tool Box", published prior to Jun. 22, 1993.

Brochure of Star Sales, Inc., entitled "CPL Products Division", published prior to Jun. 22, 1993.

*Primary Examiner*—Jimmy G. Foster
*Assistant Examiner*—Tara L. Laster
*Attorney, Agent, or Firm*—Shook, Hardy & Bacon

[57] ABSTRACT

A tool box has a bottom portion, a pair of side portions, a back portion, a front portion, and a cover rotatably mounted adjacent the back portion. The cover has a horizontal section and a slanted section sloping downwardly from the horizontal section. A partition plate is positioned in the interior of the tool box and has a row of pegs extending upwardly from the top of the partition plate. The upper ends of the pegs can contact or be in close proximity to the horizontal section of the cover when the cover is in its closed position such that tools disposed on the pegs are secured in position. A shaft is rotatably supported along the front portion and has structure attached along its length for engaging the cover to secure the cover in its closed position. The shaft is rotated by an actuating member so that the engaging structure can be brought into contact with the cover to seal the cover. A compartment is positioned in the interior near the bottom of the box and has a cover structure disposed thereon for maintaining tools in secured and unsecured positions.

20 Claims, 2 Drawing Sheets

Fig.1.
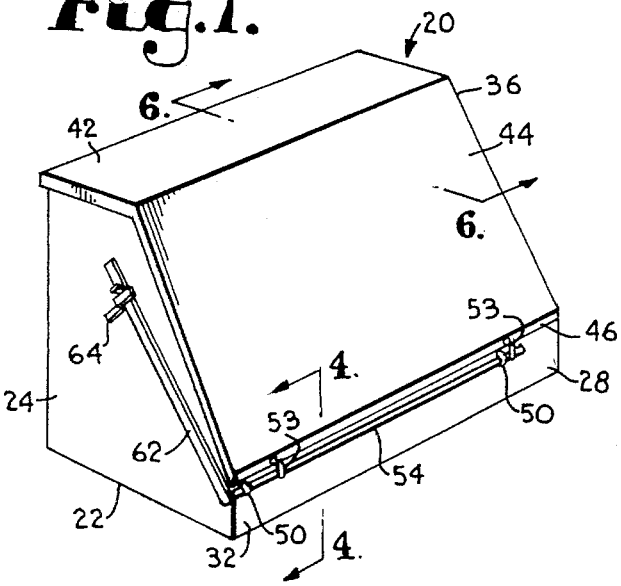
Fig.2.
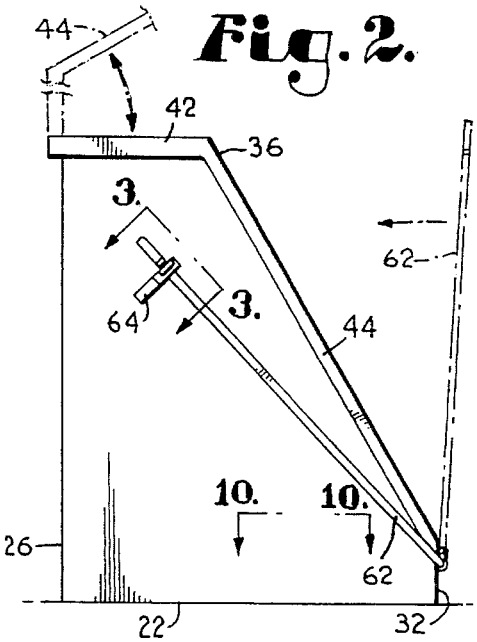
Fig.3.
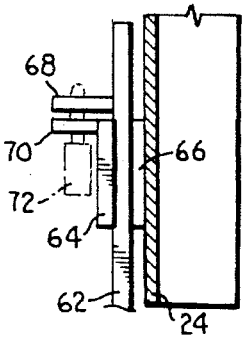
Fig.4.
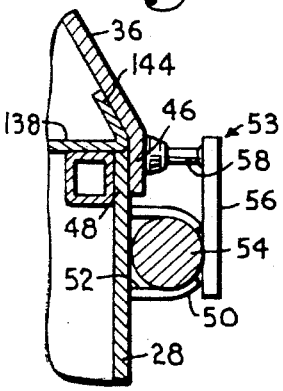
Fig.6.
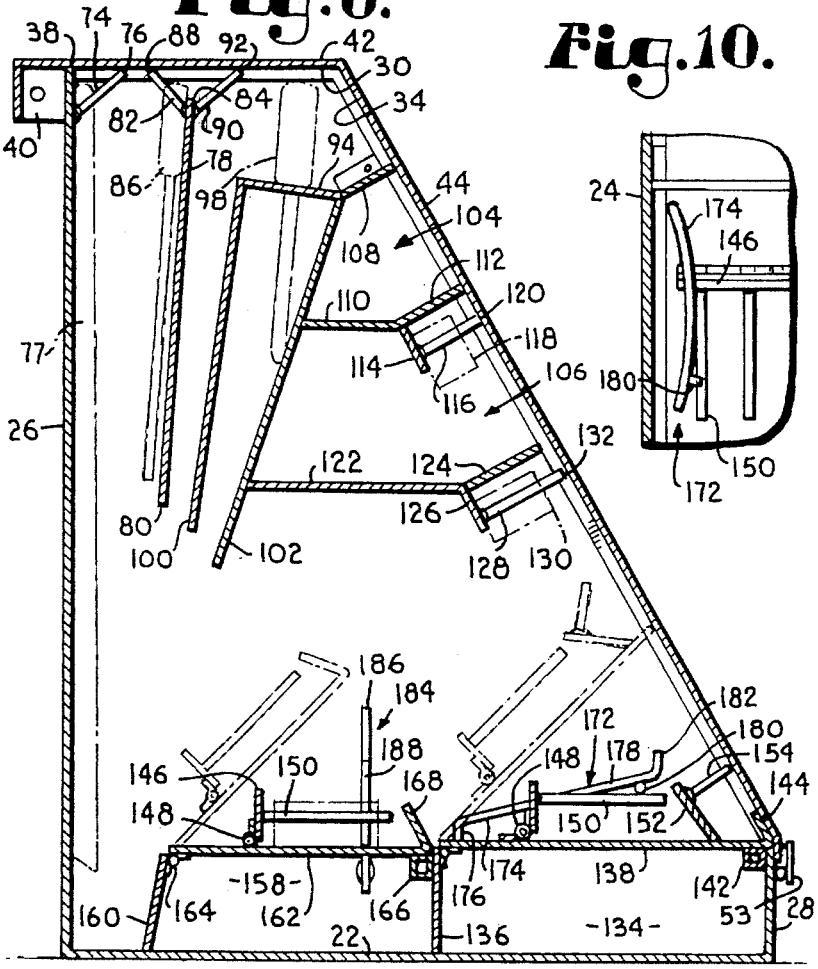
Fig.10.

TOOL BOX

BACKGROUND OF THE INVENTION

1. Field of the Invention

The present invention is directed to a tool box in which various different tools can be stored in a secure manner. More particularly, the tool box ensures that the tools contained therein are secured in place when the tool box cover is closed and provides for easy closure and securement of the tool box cover.

2. Description of the Prior Art

Numerous containers or boxes are known in the prior art for arranging tools of different sizes and structure within a tool box. For instance, tool boxes sometimes have trays with longitudinal channels therein in which sockets for use with a rachet drive are placed. Further, tool boxes with compartments in their interior for containing different sizes or structures of tools are known. The tool boxes known in the art are disadvantageous because upon rough handling of the tool box or possible inversion of the tool box, the tools disposed in designated channels or areas become displaced and scattered throughout the tool box. Numerous compartments for different sizes and structures of tools can help prevent the intermingling of tools when the tool box is handled or inverted. However, such compartments normally have individual covers which inhibit the tool box user from finding the appropriate tool when the main tool box cover is open. Thus, a tool box is needed which secures the tools placed inside such that handling of the tool box will not displace the tools from their respective positions. Furthermore, the tool box should allow visibility of the tools in their appropriate locations such that the tools can be easily found by the tool box user when the tool box cover is open.

U.S. Pat. No. 4,266,835 depicts a tool box wherein tools can be placed on different pegs such that when the cover of the tool box is closed, the tools placed on the pegs are prevented from being dislodged from their respective pegs. The tool box of the above reference also has a compartment along its base or bottom portion with a separate compartment cover. Further, the tool box has a single centrally-disposed latch for securing the entire expanse of the tool box cover in place.

The tool box depicted in the above reference is advantageous in that it secures tools placed on the pegs in their respective positions when the tool box cover is closed, and further, allows great visibility of tools contained in the box. However, the tool box offers a limited array of pegs disposed along its back portion for holding elongated tools, such as, box-end wrenches. Further, the tool box offers a limited number of pegs adjacent the tool box cover for securing sockets in place on the pegs when the cover is closed. Still further, because tool boxes are often subject to theft, the centrally-disposed latch of the tool box described above allows possible access to the box by prying up along the corners of the cover.

Thus, a tool box is needed which allows secure placement of elongated tools at various locations within the tool box other than on the rear portion of the tool box. Further, a tool box is needed which allows secure placement of tools at locations not adjacent the tool box cover and which allows tight closing of the tool box cover across its expanse.

SUMMARY OF THE INVENTION

One object of the invention is to maximize the storage capability of the tool box such that numerous tools can be secured at designated locations within the box.

Another object of the invention is to allow for maximum visibility of the tools in the box.

A further object of the invention is to allow numerous elongated tools of various sizes to be held at designated locations within the box when the tool box cover is closed.

A still further object of the invention is to prevent intermingling of the elongated tools when they are in their secured positions.

Another object of the invention is to allow tight closing of the tool box cover along its entire expanse in a convenient and simple manner.

A still further object of the invention is to securely store tools at locations in the tool box that are not adjacent the tool box cover, but that are still highly visible within the box.

According to the present invention, the foregoing and other objects are obtained by a tool box having a bottom portion, a pair of side portions, a back portion, and a front portion. The side portions each have an upper horizontal edge and a slanted edge extending forwardly and downwardly toward the front of the box. A cover is rotatably mounted at a location adjacent an upper edge of the back portion. The cover has a horizontal section which, when the cover is in a closed position, engages the upper horizontal edges of the side portions. The cover also has a slanted section sloping downwardly from the horizontal section which, when the cover is in a closed position, engages the slanted edges of the side portions. A partition plate extends between the side portions and is disposed at a position intermediate the back portion and the front portion. The partition plate extends from a location adjacent the upper horizontal edges of the side portions downwardly to a location above the bottom portion of the box such that a space is formed between the bottom portion and the lower edge of the partition plate. The space provides an expanse adjacent the bottom portion for the storage of additional items. A plurality of upwardly extending pegs are disposed adjacent an upper edge of the partition plate and along one side of the plate. Each of the pegs has an upper end which is located adjacent the horizontal section of the cover when the cover is in its closed position such that the tools with their apertures disposed on the pegs are secured in position.

In accordance with another aspect of the invention, a tool box is provided with a bottom portion, a pair of side portions, a back portion, and a front portion. A cover is rotatably mounted adjacent an upper edge of the back portion and is positionable between an open position and a closed position. The cover has a section which overlaps a section of the front portion when the cover is in its closed position. A shaft is rotatably supported along the front portion and has a first position wherein the cover is allowed to open, and a second position wherein the cover is securely closed. Structure is provided on the shaft for engaging the overlapping section of the cover when the shaft is in its second position such that pressure is applied to the overlapping section to ensure the cover is securely closed. The engaging structure further allows the cover to be rotated to its open position when the shaft is in its first position. An actuating member is attached to the shaft for rotating it between its first and second positions.

In accordance with another aspect of the invention, a tool box is provided for securing in place tools with apertures formed in their structure. The tool box has a bottom portion, a pair of side portions, a back portion, and a front portion. A compartment is formed adjacent the bottom portion and has a cover rotatably attached to a rear portion of the compartment. The compartment cover is rotatable between an open position and a closed position. A plate is rotatably attached to the compartment cover and has a plurality of pegs disposed on one surface. The pegs are for receiving the apertures of the tools. The plate is rotatable between a first position wherein the tools on the pegs are prevented from being removed and a second position wherein the tools on the pegs are removable from the pegs. A latch arrangement is attached to the compartment cover and latches the plate in its first position such that the tools on the pegs are prevented from being removed.

Additional objects, advantages, and novel features of the invention will be set forth in part in the description which follows and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

FIG. 1 is a top perspective view of a tool box embodying the present invention.

FIG. 2 is a side elevational view of the tool box of FIG. 1 showing the tool box cover in its closed and secured position, the positions for certain components when the cover is opened being shown fragmentally in phantom lines.

FIG. 3 is an enlarged fragmentary, detailed cross section taken along line 3—3 of FIG. 2.

FIG. 4 is an enlarged fragmentary, detailed cross section taken along line 4—4 of FIG. 1 and showing the tool box cover in its closed and secured position.

FIG. 6 is a cross section taken along line 6—6 of FIG. 1 showing the interior of the tool box when the tool box cover is in its closed position, the positions of certain tools and alternate positions of certain components being shown in phantom lines.

FIG. 10 is an enlarged fragmentary cross section taken along line 10—10 of FIG. 2 and showing the latching arrangement for securing the socket storage plate.

DETAILED DESCRIPTION OF THE PREFERRED EMBODIMENTS

Figure 5:
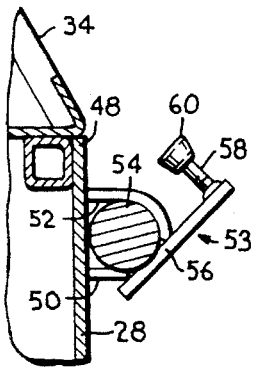
FIG. 5 is a view similar to FIG. 4, but showing the tool box cover in its open position.

With reference to FIGS. 1 and 2, tool box 20 constructed in accordance with the present invention is shown. Tool box 20 has bottom portion 22, a pair of side portions 24 extending upwardly from bottom portion 22, back portion 26 extending upwardly from bottom portion 22, and front portion 28 extending upwardly from bottom portion 22. With further reference to FIG. 6, side portions 24 each have upper horizontal edge 30 and front vertical edge 32. Upper edge 30 and front edge 32 are connected by downwardly sloping slanted edge 34. Thus, bottom portion 22, side portions 24, back portion 26, and front portion 28 define an expanse in which tools or other items can be disposed.

With additional reference to FIGS. 1, 2, and 6, cover 36 is attached to back portion 26 at a location near upper edge 38 of back portion 26. Cover 36 is attached to back portion 26 by hinge structure 40 such that cover 36 is rotatable between an open position and a closed position. With specific reference to FIG. 2, cover 36 is shown in its closed position in solid lines and partially shown in its open position in phantom lines. Cover 36 has horizontal section 42 and slanted section 44, which extends forwardly and slopes downwardly from horizontal section 42. When cover 36 is in its closed position, horizontal section 42 of cover 36 engages each upper horizontal edge 30 of side portions 24, and slanted section 44 engages each slanted edge 34 of side portions 24.

With reference to FIGS. 1–7, the arrangement for ensuring that cover 36 is securely tightened about the other portions of the box is described. When cover 36 is in its closed position, thin elongated section 46 of cover 36 overlaps section 48 of front portion 28. The cover tightening arrangement includes U-shaped bearing members 50 which are attached to front portion 28. Each bearing member 50 has an aperture 52 in which is disposed longitudinal shaft 54. Engaging arrangements 53 are placed at different locations along shaft 54 for applying pressure to overlapping section 46 of cover 36 such that cover 36 is tightened across its entire expanse.

With reference to FIGS. 4 and 5, each engaging arrangement 53 includes: plate portion 56 attached along the circumference of shaft 54, threaded rod 58 perpendicularly attached to plate portion 56, and engaging pad 60 attached to the end of threaded rod 58. Plate portion 56 can be attached to shaft 54 by any suitable means, for example, welding or by a bolt arrangement. Threaded rod 58 is attached to plate portion 56 such that as threaded rod 58 is turned, the distance between engaging pad 60 and plate portion 56 can be adjusted. Threaded rod 58 can be disposed in an aperture within plate portion 56. This aperture can have female threads for mating with the male threads of rod 58 and, thus, provide for the increased or decreased distance between engaging pad 60 and plate portion 56. Increasing or decreasing the distance between engaging pad 60 and plate portion 56 allows the tool box user to adjust how tightly cover 36 is secured to the rest of the tool box. Engaging arrangements 53 described above are shown at two different locations along shaft 54 in FIG. 1. The engaging arrangements can be increased or decreased in numbers as needed and positioned at various locations along shaft 54 so that the desired closing characteristics can be obtained.

Figure 7:
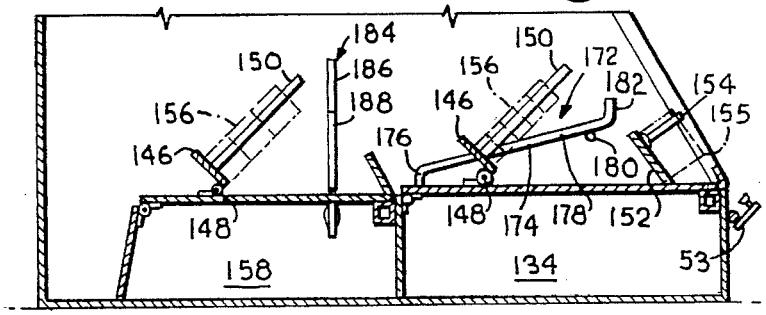
FIG. 7 is an enlarged fragmentary cross section similar to that in FIG. 6, but showing the tool box cover in its open position.

With reference to FIGS. 5 and 7, shaft 54 is shown in a first position wherein cover 36 is allowed to be rotated upwardly such that access can be obtained to the interior of the tool box. In this first position, engaging pad 60 is positioned away from overlapping section 46 of cover 36 a sufficient distance such that cover 36 can be rotated upwardly to its open position.

With reference to FIGS. 4 and 6, shaft 54 is shown in a second position wherein cover 36 is in its closed position and secured in place. In this second position, engaging pad 60 is in contact with overlapping section 46 of cover 36 so that pressure is applied to overlapping section 46 and transferred to section 48 of front portion 28 to effectuate a tight closing arrangement between overlapping section 46 and section 48. In order to close cover 36 from its open position shown in FIGS. 5 and 7, cover 36 is rotated downwardly to its closed position with shaft 54 in its first position so that overlapping section 46 engages section 48 of front portion 28. Shaft 54 is then rotated to its second position such that engaging pads 60 associated with each plate portion 56 are brought into contact with overlapping section 46 and apply pressure to overlapping section 46 to effectively secure cover 36 in place. As described above, each threaded rod 58 can be adjusted by turning the rod such that the distance between engaging pad 60 and plate portion 56 can be adjusted to thus individualize the pressure to be applied to overlapping section 46 at the individual locations of engaging arrangements 53 along shaft 54.

With reference to FIGS. 1 and 2, actuating handle 62 is attached to one end of shaft 54. Actuating handle 62 is used by the tool box user to actuate shaft 54 between its first position and its second position. With reference to FIG. 2, actuating handle 62 is shown in phantom lines in a position corresponding to the first position of shaft 54 wherein cover 36 can be rotated upwardly to its open position. With further reference to FIGS. 1 and 2, actuating handle 62 is shown in a closed or locked position corresponding to the second position of shaft 54 wherein cover 36 is secured in its closed position relative to the other portions of the tool box.

When actuating handle 62 is in its closed position corresponding to the secured position of cover 36, it engages handle support member 64. Handle support member 64 is attached to one of side portions 24 by any suitable means, for example, welding or a bolt arrangement. Support member 64 has channel 66 for receiving actuating handle 62 when it is in its closed position. Further, support member 64 and actuating handle 62 are provided with structures which allow the locking of handle 62 in its closed position and, thus, the locking of the box. With reference to FIG. 3, actuating handle 62 has locking protrusion 68 with an aperture (not shown) disposed therein and support member 64 has locking protrusion 70 also with an aperture (not shown) disposed therein. When actuating handle 62 is in its closed position, the apertures in locking protrusions 68 and 70 align such that padlock 72 (depicted in phantom lines in FIG. 3) can be positioned to lock cover 36 in place.

The closing arrangement described above provides an easy efficient way to secure cover 36 in place by using a single handle actuated by the tool box user. The length of handle 62 also provides added leverage to supply the appropriate pressure to shaft 54 and thus to engage pad 60 to effectively seal cover 36. Positioning of engaging arrangements 53 along the length of shaft 54 allows tightening force to be applied along the longitudinal expanse of cover 36 including locations adjacent the end portions. Thus, the locking force needed at the end portions to prevent a prospective thief from prying up on the corners of the cover is provided. Additionally, the tightening arrangement described above allows a single lock to be used to secure the cover along its entire expanse, thus preventing the need for multiple latches and locks along the expanse of the cover to prevent theft.

Figure 8:
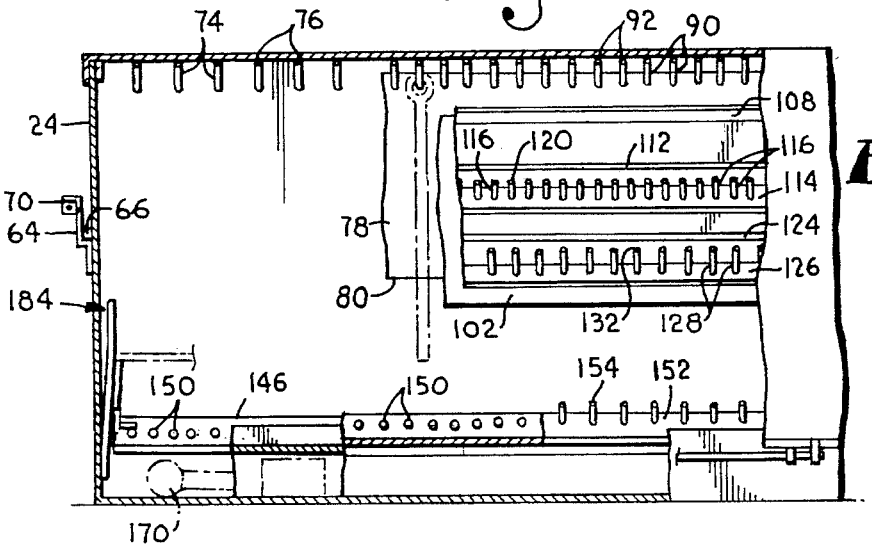
FIG. 8 is a front elevational view of the tool box of FIG. 1 showing the interior of the tool box, parts being broken away and shown in cross section to reveal details of construction.
Figure 9:
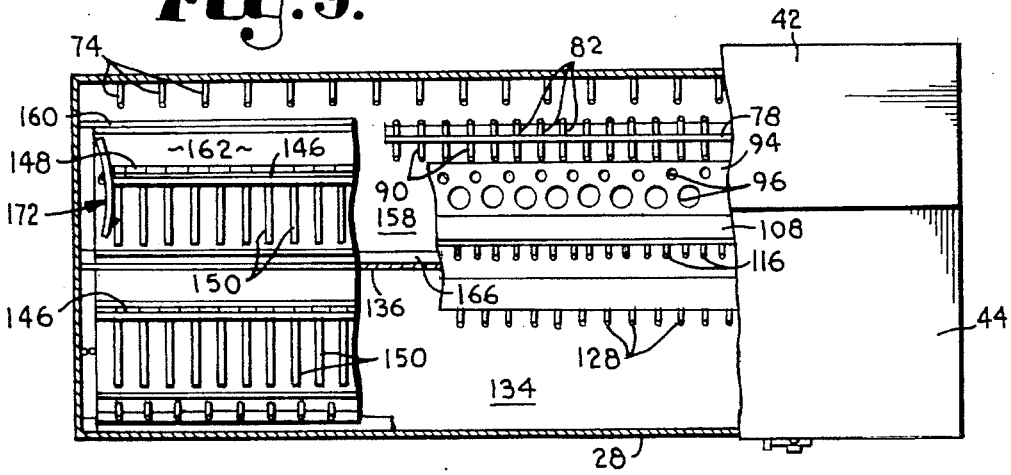
FIG. 9 is a top plan view of the tool box of FIG. 1 showing the interior of the tool box, parts being broken away and shown in cross section to reveal details of construction.

With reference to FIGS. 6, 8, and 9, the structures in the upper portion of the tool box for holding tools in designated positions will be described. A first row of pegs 74 is attached to back portion 26 at a location adjacent upper edge 38. Pegs 74 are angled upwardly from back portion 26 such that upper ends 76 of pegs 74 are in engagement with or in close proximity to horizontal section 42 of cover 36 when cover 36 is in its closed position as shown in FIG. 6. Pegs 74 are used to hold elongated tools which have apertures that allow them to be disposed about the pegs. For instance, pegs 74 can be used to hold box-end wrenches or box-end/open-end combination wrenches. With reference to FIG. 6, a box-end wrench 77 is shown disposed on one of pegs 74. The wrench is disposed such that its box or closed end, which forms the aperture in the wrench, is disposed about peg 74. As shown in FIG. 6, and as described above, upper end 76 of peg 74 contacts or is in close proximity to horizontal section 42 of cover 36 when cover 36 is in its closed position. Thus, an elongated wrench disposed about peg 74 is held in place and prevented from movement within the tool box because of the closure arrangement between back portion 26, peg 74, and horizontal section 42.

Partition plate 78 extends between side portions 24 and is attached to side portions 24 at a position intermediate back portion 26 and front portion 28. Partition plate 78 extends from a location adjacent upper horizontal edges 30 of side portions 24 to a location a substantial distance above bottom portion 22. As shown in FIG. 6, a space or expanse is formed between lower edge 80 of partition plate 78 and bottom portion 22. This space or expanse allows the storage of additional items or the positioning of additional structures within the lower portion of the tool box.

A row of pegs 82 is positioned on the side of partition plate 78 facing back portion 26. Pegs 82 are attached at their lower ends adjacent upper edge 84 of partition plate 78. As with pegs 74, pegs 82 are for holding tools having apertures which can be positioned about the pegs. As shown in FIG. 6, box-end wrench 86 (depicted in phantom lines) is disposed about one of pegs 82. Upper ends 88 of pegs 82 are positioned at a location wherein, when cover 36 is closed, horizontal section 42 comes in contact with or is in close proximity to upper ends 88. Therefore, a tool disposed about one of pegs 82 is prevented from being dislodged from peg 82 when cover 36 is in its closed position. Further, partition plate 78 prevents wrenches disposed on pegs 82 from intermingling with other tools disposed on the side of partition plate 78 opposite the side on which pegs 82 are disposed. Thus, partition plate 78 provides a barrier between tools disposed on pegs 82 and tools on the other side of plate 78 such that they do not intermingle.

A row of pegs 90 is disposed on the side of partition plate 78 that is opposite pegs 82. Pegs 90 are also positioned adjacent upper edge 84 of partition plate 78. However, pegs 90 are angled in a direction opposite to that of pegs 82. Upper ends 92 of pegs 90 also are disposed at a location such that upper ends 92 will engage or be in close proximity to horizontal section 42 of cover 36 when cover 36 is in its closed position. Thus, tools with apertures therein which are disposed about pegs 90 are prevented from being dislodged from pegs 90 when cover 36 is in a closed position in the same manner described above with regard to pegs 74 and 82.

As is apparent, partition plate 78 can be attached to side portions 24 by any suitable means, for example, welding or a bolt arrangement.

Different sets of wrenches can be designated to different rows of pegs 74, 82, and 90. For instance, pegs 74 can be positioned such that a complete set of standard wrenches can be disposed thereon, pegs 82 can be positioned such that a complete set of metric wrenches can be disposed thereon, and pegs 90 can be used for a combination of the most often used metric and standard wrenches.

The combination of partition plate 78 with pegs 82 and pegs 90 provides a unique, advantageous structure in the central section of the tool box for placement of elongated tools or devices. Pegs 74 on back portion 26 hold only one set of elongated tools which are secured by the closure of cover 36. However, partition plate 78 with pegs 82 and 90 and its unique position in the intermediate portions of the tool box allow the positioning of two additional sets of elongated tools such that they will be secured upon the closing of cover 36. The extension of partition plate 78 downwardly toward bottom portion 22 provides the necessary barrier between tools on pegs 82 and pegs 90 to prevent intermingling of the tools which could result in possible damage to the tools when the tool box is handled. Further, partition plate 78 can prevent unnecessary noise caused by the tools on rows 82 and 90 contacting one another when the box is handled. In order to further prevent noise caused by contact between tools hanging on the same row of pegs and to further hold the tools in place, padding can be applied along the inside portions of the box. For instance, padding can be applied along back portion 26 and on both sides of partition plate 78. Additionally, because partition plate 78 does not extend all the way down to bottom portion 22, it allows flexibility in positioning additional items or structure within the bottom expanse of the tool box.

With reference to FIGS. 6, 8, and 9, storage shelf 94 is positioned at a location forward of partition plate 78 and extends between side portions 24. Storage shelf 94 has a plurality of apertures 96 disposed therein. Apertures 96 receive the narrow ends of tools having enlarged handles or heads, for instance, screwdrivers or ratchet drivers. As shown in FIG. 6, screwdriver 98 (depicted in phantom lines) can be positioned with its shaft portion in one of apertures 96 such that the screwdriver's handle portion rests on shelf 94. Tools disposed in apertures 96 are prevented from being displaced from the apertures by cover 36 when it is in its closed position. As seen in FIG. 6, if the tool box is inverted or roughly handled, the handle of screwdriver 98 will abut cover 36 thus preventing it from being dislodged from aperture 96. Storage shelf 94 can thus hold a whole array of screwdrivers or ratchet drivers.

The arrangement of partition plate 78 and storage shelf 94 can be varied. For instance, pegs 90 can be eliminated and storage shelf 94 can be positioned directly against partition plate 78. With this arrangement, the elongated tools disposed on pegs 82 are still prevented from intermingling with tools disposed on the other side of partition plate 78.

Storage shelf 94 further has dividing wall 100 extending downwardly from its rear edge and also extending between side portions 24. Dividing wall 100 prevents intermingling of tools disposed in apertures 96 of storage shelf 94 with tools in the rear of the box. Storage shelf 94 also has forward dividing wall 102 extending downwardly from its forward edge and extending in between side portions 24. Dividing wall 102 prevents the intermingling of tools disposed in apertures 96 with tools in the forward portion of the box. Dividing wall 102 also provides the rear surface of upper storage bin 104 and lower storage bin 106.

An upper portion of storage bin 104 is formed by partition 108 which extends from the forward edge of storage shelf 94 and between side portions 24. The bottom of storage bin 104 is formed by partition 110 which extends forward from dividing wall 102 and between side portions 24. Partition 110 has an angled portion 112 and longitudinal plate 114 extending downwardly from the rear end of angled portion 112. Longitudinal plate 114 has a row of pegs 116 spaced across its length. Pegs 116 are for holding different sizes of sockets for a socket and rachet drive set. More particularly, the apertures in sockets 118 (depicted in phantom lines in FIG. 6) fit about pegs 116. Pegs 116 are positioned at locations along plate 114 such that different sizes of sockets can be positioned on the pegs. As shown in FIG. 6, when cover 36 is in its closed position, front ends 120 of pegs 116 engage or are in close proximity to slanted section 44 of cover 36. Thus, this engagement prevents sockets 118 from being dislodged from pegs 116 when the tool box is handled or inverted.

The bottom of storage bin 106 is formed by partition 122 which has angled portion 124. Angled portion 124 has longitudinal plate 126 extending downwardly from its rear end. A row of pegs 128 is positioned along the length of plate 126. As described above with regard to pegs 116, pegs 128 receive sockets 130 (depicted in phantom lines in FIG. 6) which are prevented from being dislodged from pegs 128 by the engagement of forward ends 132 of pegs 128 with horizontal section 42 when cover 36 is closed.

With reference to FIGS. 6–11, the compartments located in the lower portion of the tool box and the structures associated with the compartments will be described. With particular reference to FIG. 6, forward compartment 134 extends the longitudinal length of the tool box and is formed between front portion 28 and partition wall 136. Partition wall 136 extends upwardly from bottom portion 22 and between side portions 24. Compartment 134 has compartment cover 138 which is attached by hinge 140 to the upper edge of partition wall 136. Compartment cover 138 extends the length of compartment 134 and rests on its front edge on supporting member 142. Compartment cover 138 also has an angled forward portion 144 which serves as a grip for opening compartment cover 138 and further engages cover 36 when cover 36 is in its closed position such that compartment cover 138 is secured in a closed position as shown in FIG. 4. With reference to FIG. 6, compartment cover 138 is shown in its closed position in solid lines and in its open position in phantom lines.

Attached to the top of compartment cover 138 is a socket storing arrangement. This arrangement includes socket holding plate 146 which extends substantially along the entire length of compartment cover 138. Plate 146 is attached to compartment cover 138 by hinge 148. Holding plate 146 includes a row of pegs 150 extending perpendicularly from its forward facing surface. Pegs 150 can be attached to socket holding plate 146 by any suitable means, for example, welding.

Compartment cover 138 further includes abutment plate 152 extending from its top surface and angled towards the rear of the tool box. Abutment plate 152 can be attached to compartment cover 138 by any suitable means, for example, welding. Abutment plate 152 extends substantially the entire length of compartment cover 138 and includes a row of pegs 154 extending perpendicularly from the front surface of abutment plate 152. Pegs 154 can receive different sizes of sockets 155 (depicted in phantom lines in FIG. 7) and such sockets will be prevented from disengaging from pegs 154 when cover 36 is in a closed position in a manner similar to that described above with regard to pegs 116 and 128.

Pegs 150 on socket holding plate 146 receive the apertures of sockets. Each of the pegs can be appropriately spaced such that it will receive a different size of socket. Pegs 150 can further be of a circular cross section or a rectangular cross section. In FIG. 7, sockets 156 (depicted in phantom lines) are shown disposed on one of pegs 150. Socket holding plate 146 is rotatable between a first position shown in FIG. 6 wherein sockets disposed on pegs 150 are secured in position and a second position shown in FIG. 7 wherein socket holding plate 146 is rotated upwardly such that sockets 156 can be removed from pegs 150 by the tool box user. When socket holding plate 146 is in its first position, sockets disposed on pegs 150 are prevented from forward axial movement by abutment plate 152.

Rear compartment 158 is positioned behind forward compartment 134 and is formed between partition wall 136 and partition wall 160. Rear compartment 158 extends the entire length of the tool box. Rear compartment 158 has compartment cover 162 rotatably attached by hinge 164 adjacent the upper edge of partition wall 160. The forward portion of compartment cover 162 rests on supporting member 166 when compartment cover 162 is in its closed position. Supporting member 166 is attached to the rear surface of partition wall 136.

With reference to FIG. 6, compartment cover 162 is rotatable between a closed position shown in solid lines in FIG. 6 and an open position shown in phantom lines in FIG. 6.

The forward portion of compartment cover 162 further has angled abutment plate 168. Abutment plate 168 extends the full length of compartment cover 162 and can be used by the tool box user as a grip for opening compartment cover 162.

As described above with regard to compartment cover 138 of forward compartment 134, compartment cover 162 also has socket holding plate 146 rotatably attached to its top surface by hinge 148. Socket holding plate 146 further also has a row of pegs 150 disposed thereon for receiving sockets. Rotatable plate 146 with pegs 150 thereon operates in the same manner as the identical structures described above with regard to forward compartment 134. However, with regard to rear compartment 158, the axial movement of sockets 156 disposed on pegs 150 is prevented by abutment plate 168.

Different sizes of sockets can be disposed on the two different rows of pegs 150. For instance, the forward row of pegs 150 can be spaced such that a set of standard sockets can be positioned thereon. The rear row of pegs 150 can be spaced such that a complete set of metric sockets can be disposed thereon.

Compartments 134 and 158 provide additional storage area for tools or other items of irregular shape which cannot be positioned elsewhere within the tool box. For instance, as shown in FIG. 8, hammer 170 (depicted in phantom lines) or other items can be positioned within the compartments.

With reference to FIGS. 6–10, socket latching arrangement 172 will be described. Arrangement 172 is disposed on each of compartment covers 138 and 162. Arrangement 172 for compartment cover 138 is located adjacent the rear edge of compartment cover 138 and on the extreme right-hand side of compartment cover 138. Arrangement 172 for forward compartment 134 is shown in FIGS. 6 and 7. An identical latching arrangement 172 is used on compartment cover 162 of rear compartment 158. Arrangement 172 is, however, positioned at a location adjacent the rear edge of compartment cover 162 and on the extreme left-hand side of compartment cover 162. Arrangement 172 for rear compartment 158 is depicted in FIGS. 9 and 10.

Because socket locking arrangements 172 are identical for both forward compartment 134 and rear compartment 158, socket latching arrangement 172 for forward compartment 134 only will be described. With reference to FIGS. 6 and 7, arrangement 172 has flexible rod 174 which is attached to compartment cover 138. Flexible rod 174 can be attached to compartment cover 138 in any suitable manner, for example, welding or by being bolted or threaded to compartment cover 138. Portion 176 of rod 174 is attached to compartment cover 138 such that it extends perpendicularly from compartment cover 138. Portion 178 of rod 174 slants upwardly from portion 176. Slanted portion 178 has vertical portion 182 on its forward end.

Attached to the forward end of portion 178 is protrusion 180 which extends perpendicularly from portion 178. Protrusion 180 is for engaging the peg 150 disposed on the end of socket holding plate 146. With reference to FIG. 10, which is latching arrangement 172 for rear compartment 158, flexible rod 174 is deformed outwardly toward side portion 24 such that it has an arcuate shape and is biased toward the center of the tool box.

Socket latching arrangement 172 operates in the following manner. With reference to FIG. 7, holding plate 146 is in its second position such that sockets can be disposed about pegs 150. When socket holding plate 146 is in its second position, it can be resting on the top surface of protrusion 180 of rod 174. Therefore, protrusion 180 can support socket holding plate 146 with pegs 150 thereon in its second position.

Once sockets 156 have been positioned on pegs 150, the tool box user grasps vertical portion 182 and deflects rod 174 outward toward side portion 24 of the tool box. Thus, socket holding plate 146 with sockets 156 thereon is allowed to pivot downwardly to its first position. Rod 174 is then allowed to flex inward toward the center of the tool box such that protrusion 180 is positioned on top of the outermost of pegs 150. Thus, holding plate 146 is prevented from rotating upwardly by protrusion 180. As described above, when socket holding plate 146 is in its first position, sockets are prevented from being removed from pegs 150 by abutment plate 152.

The combination of socket holding plate 146 and socket latching arrangement 172 provides a convenient and unique arrangement for securing sockets in place on pegs 150 so that, if the tool box is handled roughly or inverted, the sockets will still remain in position. However, when cover 36 is opened, the tool box user can easily actuate socket latching arrangement 172 and pivot socket holding plate 146 upwardly to gain access to the sockets disposed on pegs 150. Socket latching arrangement 172 and socket holding plate 146 allow the secure positioning of sockets at locations away from cover 36. Thus, tools can be secured at locations further toward the rear of the tool box to maximize the space and utility of the tool box. As is apparent, sockets disposed on socket supporting plates 146 of compartment covers 138 and 162 are completely visible to a tool box user when cover 36 is open.

Figure 11:
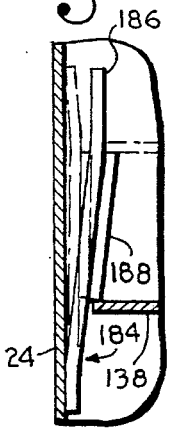
FIG. 11 is an enlarged fragmentary, detailed cross sectional view of the tool box shown in FIG. 8 showing the latching arrangement for securing the compartment cover.

With reference to FIGS. 6–8 and 11, compartment cover latching arrangement 184 will be described. The compartment cover latching arrangement is identical for both compartment cover 138 and compartment cover 162. Arrangement 184 for cover 138 of forward compartment 134 is located on left side portion 24 and is shown in FIGS. 8 and 11. Arrangement 184 for compartment cover 162 of rear compartment 158 is located on right side portion 24 and is shown in FIGS. 6 and 7. Because arrangements 184 are identical for both compartments, the latching arrangement for forward compartment 134 only will be described.

With reference to FIGS. 8 and 11, flexible rod 186 is positioned vertically and attached along its lower end to side portion 24. Rod 186 is deformed inwardly toward the center of the tool box above its point of attachment. Rod 186 can be attached to side portion 24 by any suitable means, for example, welding. Thus, rod 186 is biased toward the interior of the tool box. Abutting rod 188 is positioned along rod 186 at an intermediate location. With reference to FIG. 11, compartment cover 138 is shown in its closed position. In this closed position, the bottom of abutment rod 188 engages the top surface of compartment cover 138, thus preventing upward movement of compartment cover 138. The biasing of flexible rod 186 prevents rod 186 from moving toward side portion 24. Therefore, compartment cover 138 is secured in its closed position.

In order to open compartment cover 138, the tool box user pushes the upper portion of flexible rod 186 outward toward side portion 24 such that abutting rod 188 no longer prevents compartment cover 138 from opening. Compartment cover 138 can thus be rotated open. After compartment cover 138 is rotated to a position above the upper surface of abutting rod 188, flexible rod 186 can be released and the bottom surface of compartment cover 138 can rest on the upper surface of abutting rod 188. Thus, latching arrangement 184 can also be used to support compartment cover 138 in its open position and allow for easy access to items in the compartment. In order to rotate the compartment cover to its closed position, the tool box user simply again actuates flexible rod 186 toward side portion 24.

It will be understood that variations and changes in the details, materials, and arrangement of the parts, which have been herein described and illustrated in order to explain the nature of the invention, may be made by those skilled in the art within the principles and scope of the invention.

I claim:

1. A tool box for securing in place tools with apertures therein, comprising:

a bottom portion;

a pair of side portions extending upwardly from said bottom portion, each of said side portions having an upper horizontal edge, a front vertical edge and a slanted edge connecting said upper edge and said front edge, said slanted edge sloping downwardly from said upper edge to said front edge;

a back portion extending upwardly from said bottom portion and between said side portions;

a front portion extending upwardly from said bottom portion and between said side portions;

a cover rotatably mounted at a location adjacent an upper edge of said back portion, said cover having a horizontal section and a slanted section sloping downwardly from said horizontal section, and wherein, when said cover is in a closed position, said horizontal section engages said upper horizontal edges of said side portions and said slanted section engages said slanted edges of said side portions;

a partition plate extending between said side portions and disposed at a position intermediate said back portion and said front portion, said partition plate extending from a location adjacent said upper horizontal edges of said side portions downwardly to a location above said bottom portion such that a space is formed between said bottom portion and a lower edge of said partition plate, said space providing an expanse adjacent said bottom portion for storage of additional items; and a plurality of upwardly extending pegs disposed adjacent an upper edge of said partition plate and along one side of said partition plate, each of said pegs having an upper end which is disposed adjacent said horizontal section of said cover when said cover is in a closed position such that tools with their apertures disposed on said plurality of pegs are secured in position.

2. The tool box of claim 1, further comprising:

a second plurality of upwardly extending pegs disposed adjacent said upper edge of said partition plate and along the other side of said partition plate, each of said pegs having an upper end which is disposed adjacent said horizontal section of said cover when said cover is in a closed position such that tools with their apertures disposed on said second plurality of pegs are secured in position.

3. The tool box of claim 2, wherein said partition plate forms a barrier between tools disposed on said first plurality of pegs and tools disposed on said second plurality of pegs such that contact between tools on opposite sides of said partition plate is prevented.

4. The tool box of claim 1, wherein said partition plate forms a barrier between tools disposed on said first plurality of pegs and tools disposed in the tool box at a location on the other side of said partition plate such that contact between tools on opposite sides of said partition plate is prevented.

5. The tool box of claim 1, further comprising:

a second plurality of upwardly extending pegs disposed on the inside surface of said back portion adjacent said upper edge of said back portion, each of said pegs having an upper end which is disposed adjacent said horizontal section of said cover when said cover is in a closed position such that tools with their apertures disposed on said second plurality of pegs are secured in position.

6. A tool box for securing in place tools with apertures therein, comprising:

a bottom portion;

a pair of side portions extending upwardly from said bottom portion;

a back portion extending upwardly from said bottom portion and between said side portions;

a front portion extending upwardly from said bottom portion and between said side portions;

a compartment formed adjacent said bottom portion;

a compartment cover rotatably attached to a rear portion of said compartment and rotatable between an open position and a closed position;

a plate rotatably attached to said compartment cover, said plate having a plurality of pegs disposed thereon for receiving tools with apertures therein, and wherein said plate is rotatable between a first position in which the tools disposed on said pegs are prevented from being removed from the pegs and a second position wherein the tools disposed on said pegs are removable from said pegs;

latch means, attached to said compartment cover, for latching said rotatable plate in its first position such that the tools disposed on said pegs are prevented from being removed.

7. The tool box of claim 6, wherein said rear portion of said compartment is formed by a partition wall extending upwardly from said bottom portion at a location intermediate said back portion and said front portion.

8. The tool box of claim 6, wherein said latch means also supports said rotatable plate in its second position such that the tools can be removed from said pegs.

9. The tool box of claim 6, wherein said latch means includes a flexible rod attached on one end to said compartment cover, said rod having a protrusion laterally attached to it for engaging one of said plurality of pegs attached to said rotatable plate to hold said rotatable plate in its first position.

10. The tool box of claim 8, wherein said compartment cover further includes an abutment plate attached to said compartment cover at a location forward of said plurality of pegs, said abutment plate preventing forward axial movement of tools placed on said pegs when said rotating plate is in its first position.

11. The tool box of claim 10, wherein said abutment plate is angularly attached to said compartment cover such that one side of said abutment plate prevents the axial movement of the tools on said plurality of pegs, and wherein the other side of said plate has a second plurality of upwardly angled pegs on which tools can be disposed.

12. The tool box of claim 11, further comprising:

a tool box cover rotatably attached at a location adjacent said back portion, and wherein tools with their apertures disposed on said second plurality of pegs are secured in position on said second plurality of pegs by said tool box cover when said tool box cover is in a closed position.

13. The tool box of claim 6, further comprising:

second latch mean, attached to one of said side portions, for latching said compartment cover in its closed position and for supporting said compartment cover in its open position.

14. A tool box comprising:

a bottom portion;

a pair of side portions extending upwardly from said bottom portion;

a back portion extending upwardly from said bottom portion and between said side portions;

a front portion extending upwardly from said bottom portion and between said side portions;

a cover rotatably mounted at a location adjacent an upper edge of said back portion and positionable between an open position and a closed position, said cover having a section which overlaps a section of said front portion when said cover is in its closed position;

a shaft rotatably supported along said front portion, said shaft having a first position wherein said cover is allowed to open and a second position wherein said cover is securely closed;

engaging means, disposed on said shaft, for engaging said overlapping section of said cover when said shaft is in its second position such that pressure is applied to said overlapping section to ensure said cover is securely closed, said engaging means further allowing said cover to be rotated to its open position when said shaft is in its first position, said engaging means including adjusting means for adjusting the amount of force which is supplied to said overlapping section of said cover when said shaft is in its second position; and an actuating member attached to said shaft for rotating said shaft between its first and second positions.

15. The tool box of claim 14, wherein said adjusting means includes a threaded rod with an engaging pad disposed on one end thereof for contacting said overlapping section of said cover, and wherein said rod is rotated to adjust the force on said overlapping section.

16. A tool box comprising:

a bottom portion;

a pair of side portions extending upwardly from said bottom portion;

a back portion extending upwardly from said bottom portion and between said side portions;

a front portion extending upwardly from said bottom portion and between said side portions;

a cover rotatably mounted at a location adjacent an upper edge of said back portion and positionable between an open position and a closed position, said cover having a section which overlaps a section of said front portion when said cover is in its closed position;

a shaft rotatably supported along said front portion, said shaft having a first position wherein said cover is allowed to open and a second position wherein said cover is securely closed;

engaging means, disposed on said shaft, for engaging said overlapping section of said cover when said shaft is in its second position such that pressure is applied to said overlapping section to ensure said cover is securely closed, said engaging means further allowing said cover to be rotated to its open position when said shaft is in its first position, said engaging means including a plate portion attached to the circumference of said shaft and a rod disposed perpendicular to said plate, said rod having an engaging pad disposed on one end thereof for contacting said overlapping section of said cover; and an actuating member attached to said shaft for rotating said shaft between its first and second positions.

17. A tool box comprising:

a bottom portion;

a pair of side portions extending upwardly from said bottom portion;

a back portion extending upwardly from said bottom portion and between said side portions;

a front portion extending upwardly from said bottom portion and between said side portions;

a cover rotatably mounted at a location adjacent an upper edge of said back portion and positionable between an open position and a closed position, said cover having a section which overlaps a section of said front portion when said cover is in its closed position;

a shaft rotatably supported along said front portion, said shaft having a first position wherein said cover is allowed to open and a second position wherein said cover is securely closed;

engaging means, disposed on said shaft, for engaging said overlapping section of said cover when said shaft is in its second position such that pressure is applied to said overlapping section to ensure said cover is securely closed, said engaging means further allowing said cover to be rotated to its open position when said shaft is in its first position; and a handle for rotating said shaft between its first and second positions and attached to one end of said shaft such that said handle is rotatable adjacent one of said side portions, said handle having a first position corresponding to said first position of said shaft and a second position corresponding to said second position of said shaft.

18. The tool box of claim 17, further comprising:

a handle support member extending from said one of said side portions, said handle support member supporting and engaging said handle when said handle is in its second position.

19. The tool box of claim 18, wherein said handle support member and said handle have locking means for locking said handle in its second position such that said cover is securely closed.

20. A tool box comprising:

a bottom portion;

a pair of side portions extending upwardly from said bottom portion;

a back portion extending upwardly from said bottom portion and between said side portions;

a front portion extending upwardly from said bottom portion and between said side portions;

a cover rotatably mounted at a location adjacent an upper edge of said back portion and positionable between an open position and a closed position, said cover having a section which overlaps a section of said front portion when said cover is in its closed position;

a shaft rotatably supported on said front portion by a bearing member attached to said front portion, said bearing member having an aperture therein through which said shaft is disposed, said shaft having a first position wherein said cover is allowed to open and a second position wherein said cover is securely closed;

engaging means, disposed on said shaft, for engaging said overlapping section of said cover when said shaft is in its second position such that pressure is applied to said overlapping section to ensure said cover is securely closed, said engaging means further allowing said cover to be rotated to its open position when said shaft is in its first position; and an actuating member attached to said shaft for rotating said shaft between its first and second positions.

* * * * *